US011605915B2

(12) United States Patent
Chen

(10) Patent No.: US 11,605,915 B2
(45) Date of Patent: Mar. 14, 2023

(54) PLASTIC SHELL FOR MOUNTING CONNECTION TERMINAL AND CONNECTION TERMINAL

(71) Applicant: Xiamen Ghgm Electric Co., Ltd., Xiamen (CN)

(72) Inventor: Bingshui Chen, Xiamen (CN)

(73) Assignee: XIAMEN GHGM ELECTRIC CO., LTD., Xiamen (CN)

( * ) Notice: Subject to any disclaimer, the term of this patent is extended or adjusted under 35 U.S.C. 154(b) by 80 days.

(21) Appl. No.: 17/216,675

(22) Filed: Mar. 30, 2021

(65) Prior Publication Data

US 2022/0285876 A1 Sep. 8, 2022

(51) Int. Cl.

| | |
|---|---|
| ***H01R 13/50*** | (2006.01) |
| ***H01R 13/508*** | (2006.01) |
| ***H01R 13/504*** | (2006.01) |
| ***H01R 13/516*** | (2006.01) |

(52) U.S. Cl.

CPC ..... *H01R 13/508* (2013.01); *H01R 13/504* (2013.01); *H01R 13/516* (2013.01)

(58) Field of Classification Search

CPC . H01R 13/5208; H01R 4/4818; H01R 12/515
See application file for complete search history.

(56) References Cited

U.S. PATENT DOCUMENTS

| | | | | |
|---|---|---|---|---|
| 7,513,793 | B2 * | 4/2009 | Horst | H01R 4/4818 439/427 |
| 8,568,157 | B2 * | 10/2013 | Bishop | H01R 4/2433 439/389 |
| 9,831,581 | B2 * | 11/2017 | Fu | H01R 4/4827 |
| 10,389,049 | B2 * | 8/2019 | Stromiedel | H01R 12/53 |
| 10,665,968 | B2 * | 5/2020 | Otaka | H01R 4/48 |
| 2006/0189174 | A1 * | 8/2006 | Fabian | H01R 4/4836 439/66 |
| 2013/0237095 | A1 * | 9/2013 | Keswani | H01R 13/6271 439/626 |

* cited by examiner

*Primary Examiner* — Truc T Nguyen

(57) ABSTRACT

A plastic shell for mounting a connection terminal includes a main body configured as an integral single component. The main body includes a top surface and a bottom surface opposed to each other. The bottom surface is depressed toward the top surface to form an internal space for accommodating a conductive terminal. A connecting portion for mating with the clamping portion of the conductive terminal is disposed in the internal space. A front end surface of the main body has a wire insertion hole for inserting a wire into the conductive terminal, and the wire insertion hole is in communication with the internal space.

9 Claims, 13 Drawing Sheets

PLASTIC SHELL FOR MOUNTING CONNECTION TERMINAL AND CONNECTION TERMINAL

CROSS REFERENCE TO RELATED APPLICATION

This application claims all benefits accruing under 35 U.S.C. § 119 from China Patent Application No. 202110228974.5, filed on Mar. 2, 2021 in the China National Intellectual Property Administration, the content of which is hereby incorporated by reference.

TECHNICAL FIELD

The present disclosure relates to the technical field of electrical connector, in particular to a plastic shell for mounting connection terminal and a connection terminal.

BACKGROUND

Electrical connectors are used to connect two ends of a power line or data line and other wires together for power or electronic data transmission components. Connectors are used in airplanes and ships, as well as computers and mobile phones. Almost all electronic products use connectors.

As electronic products become more and more complex, the requirements for stable electrical connection performance are also correspondingly improved. As a very important and widely used electrical connection product, the connector is used to realize the electrical connection and conduction after the plug-in unit (such as wire) is connected, and disconnect the electrical connection after the plug-in unit is separated. Therefore, the telecom contact quality of the electrical connection is particularly important, and the main factor affecting the contact quality of the electrical connector is the configuration between the terminal and the plastic shell. In the process of realizing electrical connection between the conductive terminal and the plug-in unit, the plug-in unit is inserted into the shell and electrically contacts with the conductive terminal. It is particularly important that there are various types of terminal plastic shell structures in the existing technology. However, for the existing terminal plastic shell structures, there are many defects, such as unreasonable design, inconvenient batch manufacturing, defective construction and so on, which lead to complicated manufacturing and low production efficiency.

SUMMARY

In view of this, the objective of the present disclosure is to provide a plastic shell for mounting the connection terminal and provide a connection terminal to solve the above-mentioned problem.

The present disclosure adopts the following solution:

A plastic shell for mounting a connection terminal is provided by the present disclosure, including a main body, wherein the main body is configured as an integral single component. The main body includes a top surface and a bottom surface that are opposed to each other, the bottom surface is depressed toward the top surface to form an internal space for accommodating a conductive terminal, the internal space is provided with a connecting portion for mating with the clamping portion of the conductive terminal; a front end surface of the main body is provided with a wire insertion hole for inserting a wire into the conductive terminal, and the wire insertion hole is communicated with the internal space. Limited by the maximum width of the wire insertion hole, the top surface is cut and extends downward to the bottom surface of the main body, so as to form a first cutting surface at the front end surface of the main body and a second cutting surface at the bottom surface of the main body at upper and lower positions of the wire insertion hole and projections of the first cutting surface and the second cutting surface in a first direction is not overlapped.

As a further improvement, the top surface of the main body extends towards the bottom, and is communicated with the internal space to form the connecting portion.

As a further improvement, the wire insertion hole extends backward and penetrates through a rear end surface of the main body, so as to make inserted wires penetrate the main body.

As a further improvement, the top surface and the bottom surface are enclosed by the side wall to form a hollow shell shape; the wire insertion hole penetrates on the side wall, and an exposed opening is correspondingly provided along the side wall opposite to the wire insertion hole, and the exposed opening is formed by depressing along an outer periphery of the top surface and hollowing out the side wall; the wire insertion hole and the exposed opening are communicated with the internal space.

As a further improvement, the front end surface of the main body forms a guiding area centered on the wire insertion hole, and the guiding area is configured to guide wires to be inserted into the wire insertion hole.

Further, A connection terminal is provided by the present disclosure, including a plastic shell for mounting a connection terminal and a conductive terminal arranged in the plastic shell body as described above. The conductive terminal is a contact frame, and the contact frame is provided with a clamping joint for wire to insert and a clamping portion for clamping with the connecting portion of the plastic shell. The clamping joint is composed of a pair of elastic members, and free ends of the two elastic members form inner bending structures and the inner bending structures are symmetrically arranged in the contact frame, so that the wire is clamped elastically after the wire enters into a wire passing channel along the wire insertion hole of the main body.

As a further improvement, the contact frame is integrally formed by metal parts, including a support bottom and a mounting side portion. The support bottom is in strip plate shape and is located below the wire passing channel, a length direction of the support bottom is consistent with a direction of the wire passing channel; the mounting side portion is vertically configured on both sides of the support bottom to form two wing structures, and the contact frame is clamped and assembled in the main body by the two side wing structures.

As a further improvement, the elastic member is a leaf spring, and the leaf spring is extended and arranged at the mounting side portion and directs to a opposite direction of wire insertion. The end of the elastic member far away from the free end is provided at one side of the mounting side portion in an integrated manner, and forms an elastic free end transversely arranged on the support bottom by at least once bending inward.

As a further improvement, the clamping position of the contact frame is that a width between the two mounting side portions is 1.4 mm to 2.4 mm, and the length of the inner bending is 0.5 mm to 1.1 mm.

As a further improvement, the internal space of the plastic shell body includes a first mounting cavity and a second mounting cavity, the first mounting cavity and the second mounting cavity form a stepped bottom surface, and the clamping portion of the conductive terminal is located in the second mounting cavity, so as to bear some or all force when the wires is inserted into the conductive terminal.

Other features of the present disclosure will become apparent from the following description of exemplary embodiments (with reference to the accompanying drawings).

BRIEF DESCRIPTION OF THE DRAWINGS

The following drawings are briefly introduced in order to more clearly illustrate the technical solution of the embodiment of the present disclosure. It should be understood that the following drawings only show some embodiments of the present disclosure, which should not be regarded as the limitation of the scope. For ordinary technicians in the art, other related figures can be obtained according to these drawings.

DETAILED DESCRIPTION OF THE EMBODIMENTS

Figure 1:
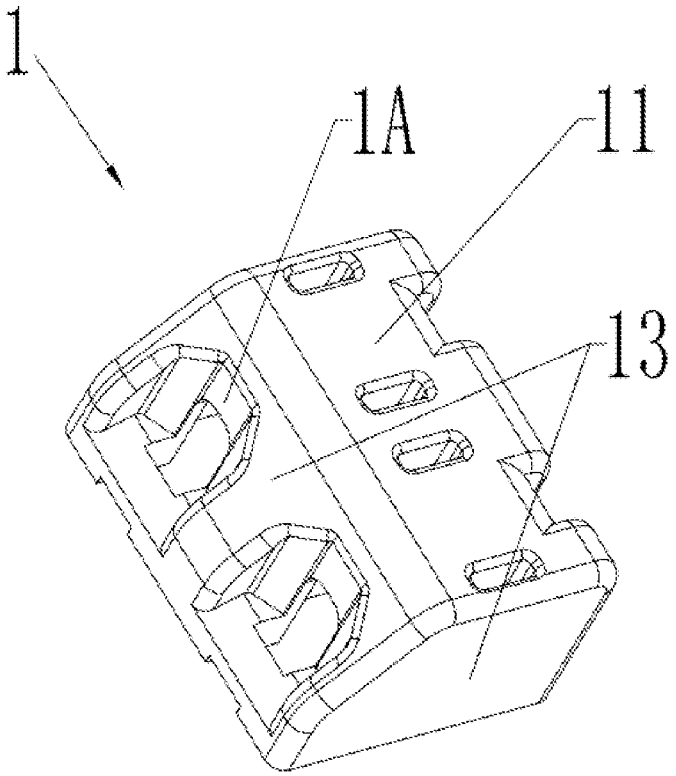
FIG. 1 is a structural diagram of a plastic shell for mounting the connection terminal in the embodiment of the present disclosure from the first perspective.
Figure 2:
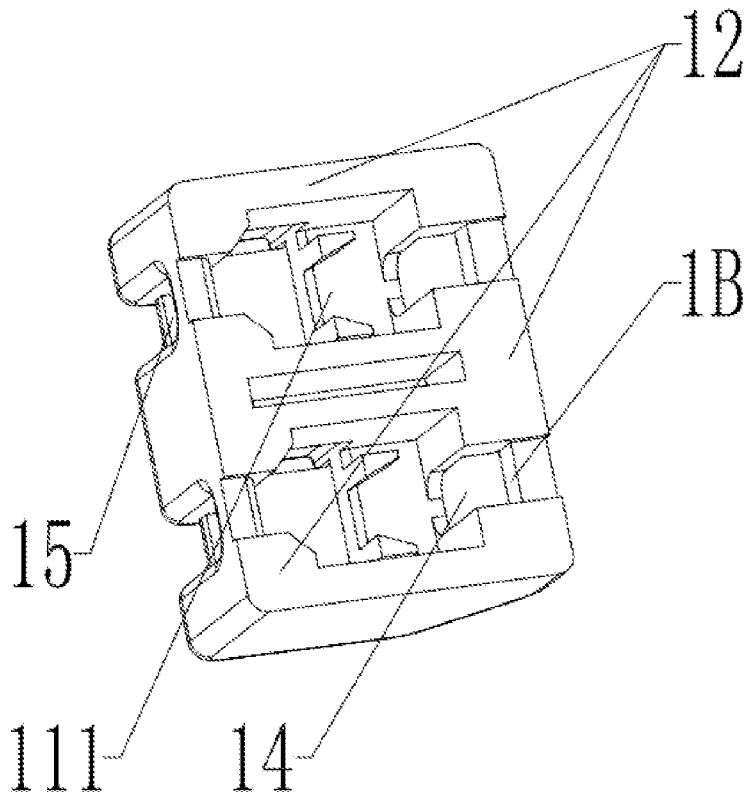
FIG. 2 is a structural diagram of the plastic shell for mounting the connection terminal in the embodiment of the present disclosure from a second perspective.
Figure 3:
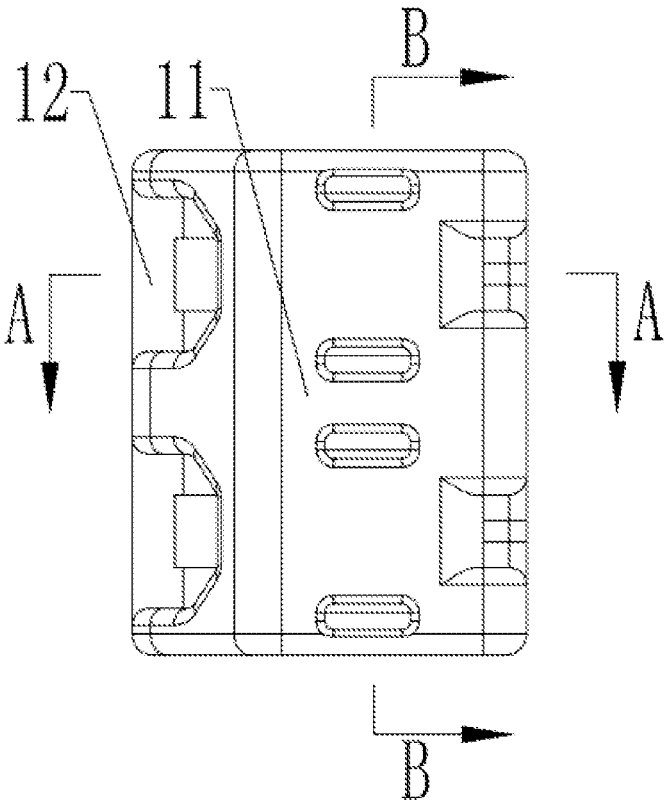
FIG. 3 is a structural diagram of the plastic shell for mounting the connection terminal in the embodiment of the present disclosure from a third perspective.

In order to make the purpose, technical solution and advantages of the embodiment of the present disclosure clearer, the technical solution in the embodiment of the present disclosure will be described clearly and completely in combination with the drawings.

Embodiment

With reference to FIG. 1 to FIG. 6, the present embodiment provides a plastic shell for mounting the connection terminal, including a plastic shell main body 1, wherein the main body 1 is configured as an integral single component. The main body 1 includes a top surface 11 and a bottom surface 12 that are opposed to each other, the bottom surface 12 is depressed toward the top surface 11 to form an internal space for accommodating a conductive terminal. The internal space is provided with a connecting portion for mating with the clamping portion of the conductive terminal. A front end surface of the main body 1 is provided with a wire insertion hole 14 for inserting a wire into the conductive terminal, and the wire insertion hole 14 is communicated with the internal space. Limited by the maximum width of the wire insertion hole 14, the top surface 11 is cut and extends downward to the bottom surface of the main body, so as to form a first cutting surface 1A at the front end surface of the main body 1 and a second cutting surface 1B at a bottom of the main body at upper and lower positions of the wire insertion hole 14, and projections of the first cutting surface 1A and the second cutting surface 2B in the first direction is not overlapped.

In the present embodiment, the plastic shell main body 1 is a separate component formed in one body, which is convenient for manufacturing and production. The main body 1 is enclosed into a shell with an internal space by the top surface 11, the bottom surface 12 and the side wall 13. Besides, the bottom surface is sunken to form at least part of the internal space, so that the main body 1 is configured into a shell with a hollowed bottom surface, which can effectively save material, reduce production costs, and is conducive to daily maintenance and internal heat dissipation during electrical connection, which is effective and practical.

In addition, part of the bottom surface 12 is sunken to coincide with the inner wall of the top surface 11, and the outer wall of the bottom surface 12 is formed at the bottom of each side wall. When looking down on the main body 1 in the first direction, the projections of the cutting surface 1A formed on the front end surface of the main body 1 (one of the side walls 13) and the second cutting surface 1B formed on the bottom surface 12 of the main body 1 do not overlap. On the one hand, the wall thickness and connection strength are ensured, which is more reliable, not easy to break. On the other hand, the top surface 11 and the bottom surface 12 are configured in such a way, which is conducive to the rapid demoulding of the plastic shell along the vertical direction during molding, and can well avoid the inverted structure, so as to eliminate the use of the redundant slider in the injection mold, making the manufacturing of the plastic shell simple and efficient. The structure has the advantages in novel structural design, convenient production and manufacturing, and avoids the limitations of the manufacturing and use of the plastic shell, so that other aspects and advantages of the disclosure become extremely obvious.

It is particularly important that the top surface 11 and the bottom surface 12 are not overlapped at least on the front end surface side, and there is a space margin between them, so that when the main body is clamped automatically during transmission, the alignment detection module equipped in the clamping mechanism (not shown in the figure) on the front end surface side can directly penetrate into the inside and outside of the main body along the first direction, so as to achieve convenient alignment and detection operation, which is very suitable for automatic production line.

In some embodiments, the first direction is the vertical direction passing through the top surface 11 and the bottom surface 12, and is perpendicular to the wire insertion direction. In addition, the wire insertion hole 14 is a regular or irregular hole structure, and its maximum width is the maximum width distance along the transverse direction.

Figure 8:
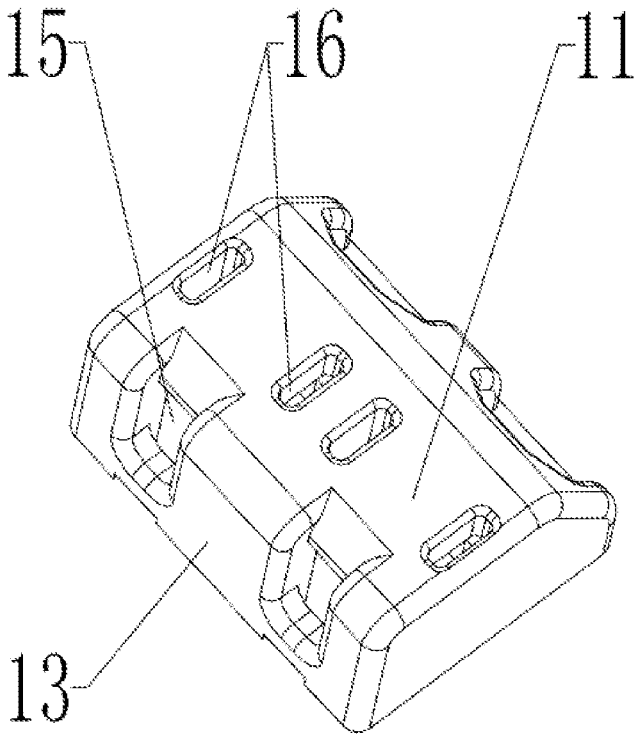
FIG. 8 is a structural diagram of the plastic shell for mounting the connection terminal in the embodiment of the present disclosure from other perspectives.
Figure 9:
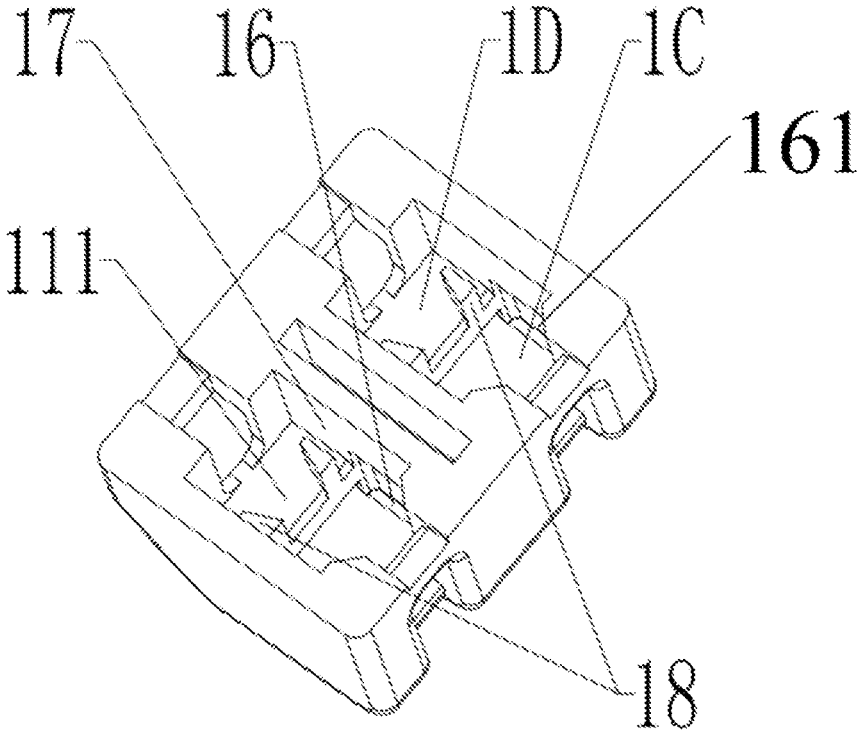
FIG. 9 is a structural diagram of the plastic shell for mounting the connection terminal according to the embodiment of the present disclosure.

Referring to FIG. 8 and FIG. 9, in one embodiment, the top surface 11 of the main body cuts and extends toward the bottom surface 12, and communicates with the internal space to form a connecting portion. The top surface 11 is provided with a through hole 16, and the through hole 16 only passes through the top surface 11 and can be depressed in the inner wall of the main body 1 to form a connecting portion with a clamping surface. Specifically, the main body 1 also includes a retaining wall 17 separating the internal space. The retaining wall 17 is transversely arranged in the main body 1 along the wire insertion direction and divides the internal space into a plurality of subspaces for the assembly of conductive terminals, and each subspace has a wire passing channel, so as to ensure that each subspace can insert wires separately to make full use of the internal space.

In some embodiments, the through hole 16 in the subspace is partially depressed on the retaining wall 17 and the inner wall of the side wall 13 opposite to the retaining wall 17, so as to ensure that each subspace has at least a connection portion which can realize the clamping of the conductive terminal, so that the conductive terminal can be assembled and fixed in the main body 1.

In one embodiment, the wire insertion hole 14 extends backward and penetrates the rear end surface of the body 1, so that the inserted wire can penetrate the main body 1. The top surface 11 and the bottom surface 12 are enclosed by the side wall 13 to form a hollow shell shape. The wire insertion hole 14 penetrates on the side wall 13, and an exposed opening 15 is correspondingly provided along the side wall 13 opposite to the wire insertion hole 14. The exposed opening 15 is formed by depressing along the outer periphery of the top surface 11 and hollowing out the side wall 13. The wire insertion hole 14 and the exposed opening 15 are communicated with the internal space. After the wire crosses through the wire insertion hole 14 and enters the internal space, the wire terminal can hold the wire and allow the wire to continue to pass through the main body 1 until the end of the wire at least partially passes through the exposed opening 15, so that the user can directly observe the wire exposed outside the exposed opening 15.

Thus, by forming a wire insertion hole 14 and an exposed opening 15 opposite to the wire insertion hole 14 on the side wall 13 of the main body 1, and the wire passing channel is located between the wire insertion hole 14 and the exposed opening 15, when the wire enters the main body 1 along the wire insertion hole 14, the wire is clamped in the conductive terminal and can continue to pass through the main body 1 until the end of the wire passes through the exposed opening 15 to expose the outside of the main body 1. So that the user can directly know that the wire runs through the main body 1 entirely, realizing the electrical connection of complete insertion, which not only greatly facilitates the wiring use, but also obtains the wire insertion situation. In addition, the through plug can make the specification of the terminal more narrow and compact, so as to save the cost and meet the miniaturization design.

In one embodiment, specifically, the wire insertion hole 14 is connected with the wire passing channel, and the front end of the side wall 13 where the wire insertion hole 14 is located is depressed along the insertion direction to form a guiding area 131. The front end surface of the main body forms a guiding area 131 centered on the wire insertion hole, and the guiding area 131 is configured to guide wires to be inserted into the wire insertion hole 14. The guiding area 131 is vertically depressed from top to bottom and can be communicated with the internal space through the wire insertion hole 14. Thus, on the one hand, the depression is formed in the guiding area 131 outside the side wall 13 to provide shielding and protection for the wires after insertion, so as to avoid being affected by the external environment. On the other hand, the guiding area 131 is vertically depressed and can penetrate downwardly with the bottom surface 12, so as to avoid the occurrence of the inverted structure on the forming die, which is further conducive to the vertical demoulding of the plastic shell body 1.

In particular, the side walls 13 without the wire insertion hole 14 and the exposed opening 15 are located on both sides of the main body 1, the side walls 13 are parallel plane to each other and the wall thickness is equivalent, so as to meet the needs of production and manufacturing.

In addition, in one embodiment, the side connection is formed at the outer circumferences of the top surface 11 and the bottom surface 12, so that the side walls 13 of the main body 1 are smoothly butted with the top surface 11 and the bottom surface 12. The outer circumference of the top surface 11 does not coincide with the inner circumference of the bottom surface 12 formed at the bottom of the side wall 13 along the vertical direction (the first direction). Therefore, the avoiding arrangement of the top surface 11 and the bottom surface 12 can provide more convenient conditions for the main body 1 during injection molding and demolding, which is conducive to the pull-out operations in the up and down directions respectively, and reduces unnecessary side sliders, so as to realize one-time demolding, and the reasonable design of the thickness of the wall of each side wall 13 is ensured, which is more firm and reliable.

It should be noted that the outer circumference of the top surface 11 and the outer circumference of the bottom surface 12, as well as the inner circumference of the top surface 11 and the inner circumference of the bottom surface 12 are respectively connected through the side walls 13, and the inner circumference of the bottom surface 12 is set to be spaced apart from the outer circumference of the top surface 11 in the vertical direction, so as to further ensure that the bottom surface 12 and the top surface 11 do not overlap, and create convenient conditions for one-time demoulding after injection molding.

Figure 7:
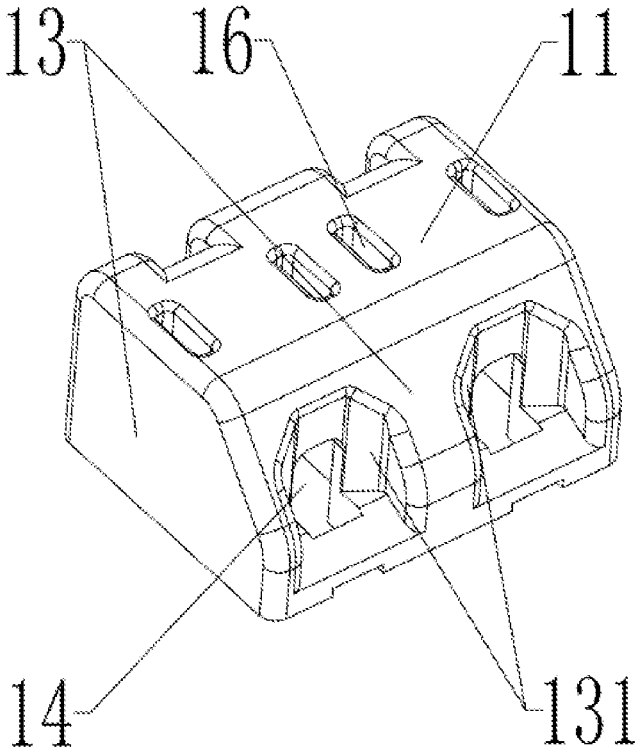
FIG. 7 is a structural diagram of the plastic shell for mounting the connection terminal in the embodiment of the present disclosure from another perspective.

Referring to FIG. 7, FIG. 8 and FIG. 9, in one embodiment, the side wall 13 facing the wire insertion direction is configured as an arc-shaped surface. The wall thickness of the side wall 13 is generally in the shape of a wedge with narrow top and wide bottom. Part of the bottom surface is depressed and extended downwardly to the side wall 13, and part of the side wall 13 can be hollowed out to form a wire insertion hole 14 penetrating inside and outside the main body 1. The side wall 13 on the side of the insertion direction is different from the other side walls, which is beneficial for the user to identify the required insertion end and has the foolproof function. The wall thickness is set to be wide at the lower part, which increases the stability and strength of the main body 1.

Referring to FIG. 10 to FIG. 19, this embodiment provides another connection terminal, which includes the above plastic case for mounting the connection terminal and the conductive terminal arranged in the plastic case body 1. The conductive terminal is a contact frame 2, and the contact frame 2 is provided with a clamping joint 21 for the wire insertion and a clamping portion 231 for clamping with the connecting portion 161 of the plastic shell. And the clamping joint 21 is composed of a pair of elastic members 211, and free ends of the two elastic members 211 form inner bending structures and are symmetrically arranged in the contact frame 2. So that the elastic cooperation between the inner bending structures enables the wire to be elastically clamped after the wire enters the wire passing channel along the wire insertion hole 14 opened in the main body 1.

In this embodiment, the wire is clamped and fixed by the clamping joint 21 of the contact frame 2. The clamping joint 21 is composed of a pair of elastic members 211, and the free end of the elastic member 211 is an inner bending structure, and the two inner bending structures symmetrically arranged on the contact frame 2 form a wire insertion space which is roughly in the shape of a trumpet shape. There is a spacing between the two ends of the free ends which allows the insertion and withdrawal of wires, which is conducive to the external wires entering through the wire insertion space along the wire insertion hole 14. Thus, the wire is inserted and penetrated into the spacing between the two ends, and then clamped in the inner bending structures of the elastic members 211, so that the elastic force of the wire is tightly matched on the contact frame 2. The two inner bending structures continuously provide the wire with a substantially centered elastic clamping force, and the wire is arranged smoothly and centrally in the clamping joint 21 along the clamping direction to achieve a stable clamping of the wire.

Figure 11:
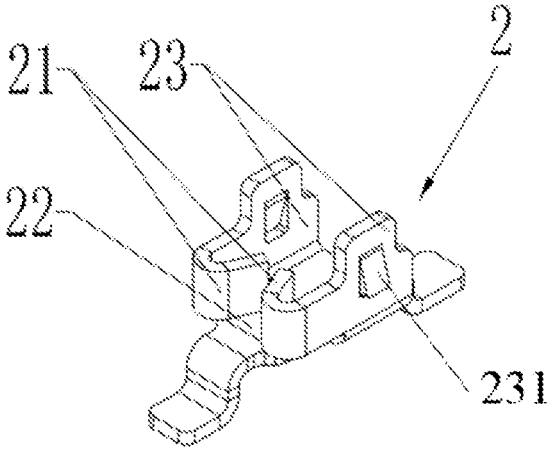
FIG. 11 is a structural diagram of the contact frame of the new connection terminal in the embodiment of the present disclosure.
Figure 12:
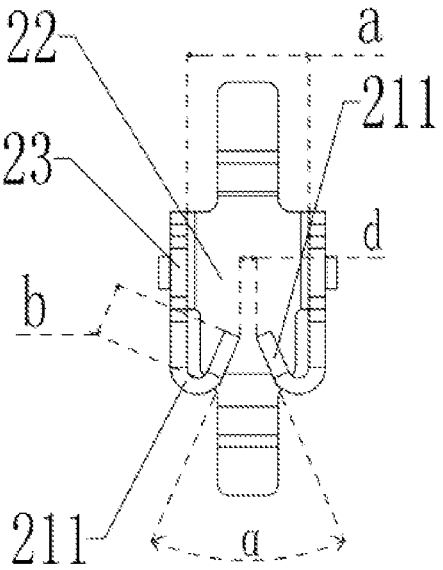
FIG. 12 is a structural diagram of FIG. 11 from an another perspective.
Figure 13:
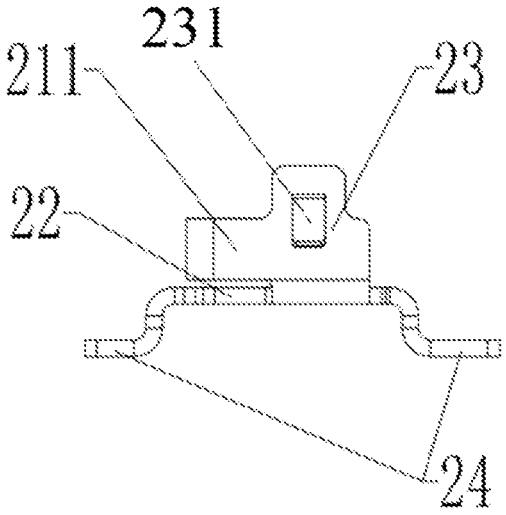
FIG. 13 is a structural diagram of FIG. 11 from the other perspective.
Figure 14:
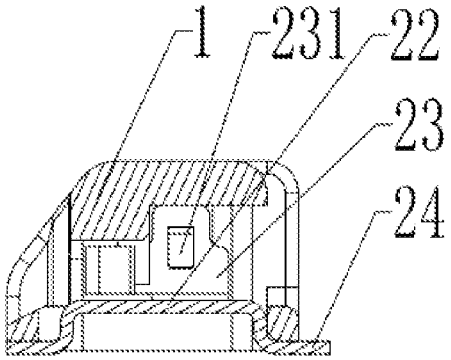
FIG. 14 is a sectional view of a connection terminal according to an embodiment of the present disclosure.
Figure 15:
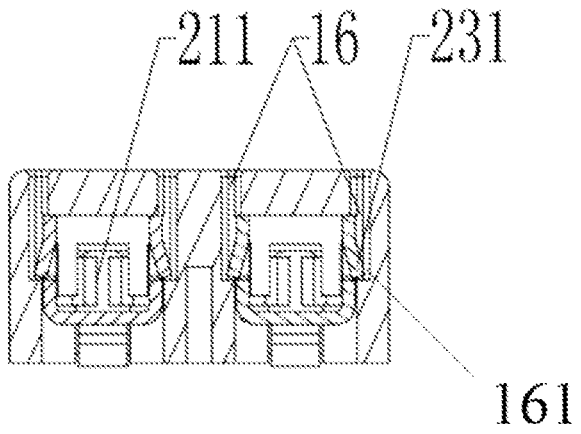
FIG. 15 is another sectional view of the connection terminal of the embodiment of the present disclosure.
Figure 16:
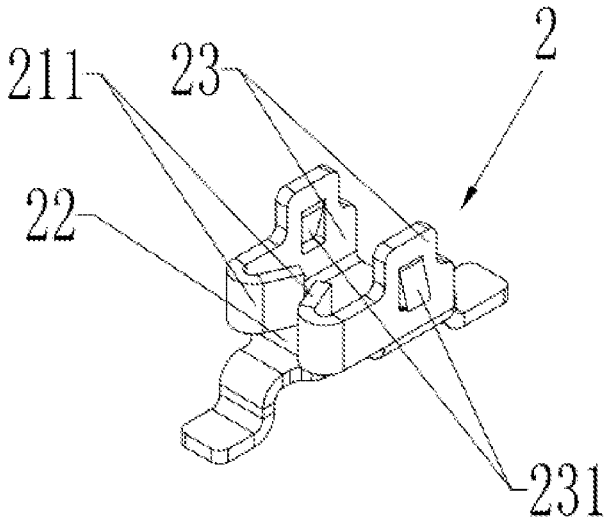
FIG. 16 is a structural diagram of the contact frame of the connection terminal in the embodiment of the present disclosure from the other perspective.
Figure 17:
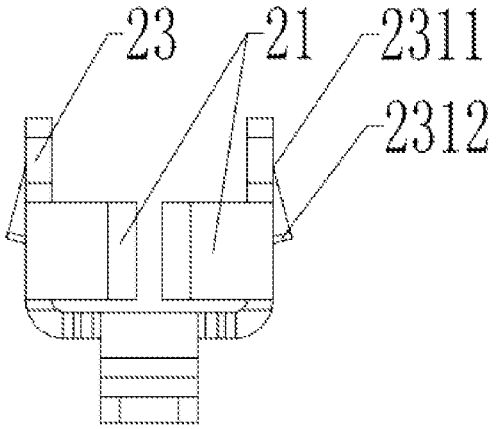
FIG. 17 is a structural diagram of FIG. 16 from an another perspective.

Referring to FIG. 11 to FIG. 13, in one embodiment, the contact frame 2 is integrally formed by metal parts, including a support bottom 22 and a mounting side portion 23. The support bottom 22 is in strip plate shape and is located below the wire passing channel, the length direction of the support bottom is consistent with a direction of the wire passing channel. The mounting side portions 23 are vertically configured on both sides of the support bottom 22 to form two wing structures, the contact frame 2 is clamped and assembled in the main body 1 by the two side wing structures. The mounting side portion 23 of the contact frame 2 formed integrally by the metal parts are arranged vertically on both sides of the support bottom 22 to form the side wing structures, and then the side wing structures are clamped and assembled in the main body 1 to realize the tight fitting of the contact frame 2 in the main body 1, which is conducive to disassembly and maintenance.

In one embodiment, specifically, the elastic member 211 is a leaf spring, and the leaf spring is extended and arranged at the mounting side portion 23 and directs to a opposite direction of wire insertion. The end of the elastic member 211 far away from the free end is provided at one side of the mounting side portion 23 in an integrated manner, and forms an elastic free end transversely arranged on the support bottom 22 by at least once bending inward. Therefore, under the elastic limit of the free ends on both sides, the externally inserted wire can be clamped between the two mounting side portions 23 in a centering manner, ensuring that the wire can be clamped firmly under the function of the bidirectional elastic force to achieve electrical connection.

In some embodiments, there is always a gap between the leaf spring and the support bottom. It further promotes the free swing of the elastic member 211 on the contact frame 2 to provide efficient elastic clamping or reverse pulling out of the wire. In this embodiment, the releasing of the wire can be realized by setting an operating mechanism (not shown in the figure) for controlling the swing of the elastic member 211 to release the wire that needs to be pulled out reversely to the outside of the main body 1, so as to pull out the wire. A retreat space may be configured on the back of the inner bending structure, and the retreat space and the wire insertion space on the front side of the inner bending structure are opposed to each other in the wire passing channel. The retreat space is elastically engaged with the wire placed on the clamping joint 21 in a point contact manner, so that the wire can be separated from the clamping joint 21 when the user directly pulls the wire in the reverse direction.

In one embodiment, the body of the support bottom 22 is lifted upward, so that the two ends are configured as the welding leg structures 24, and the whole middle portion is a upward protrusion and is connected with the welding leg structures 24 in an arc transition. The mounting side portion 23 and the clamping joint 21 are all located in the middle position. Therefore, the functional components for clamping and assembling are elastically supported in the main body 1, which is conducive to the clamping of wires and the stable configuration of the contact frame 2. Moreover, the welding leg structures 24 can be installed in place with the main body 1 in a nested clamping manner, and cooperate with the side wing structure to fix the whole contact frame 2 in the main body 1.

Figure 4:
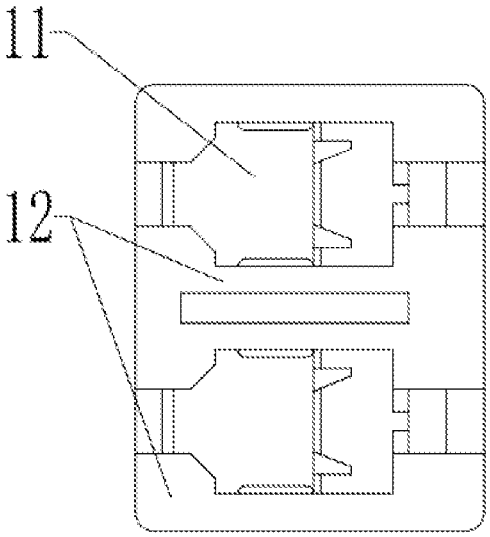
FIG. 4 is a structural diagram of the plastic shell for mounting the connection terminal in the embodiment of the present disclosure from a fourth perspective.
Figure 5:
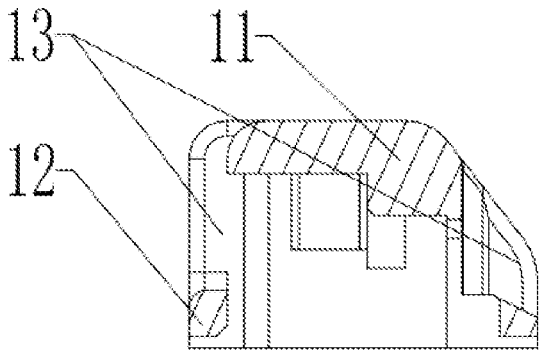
FIG. 5 is a sectional view at A-A in FIG. 3.
Figure 6:
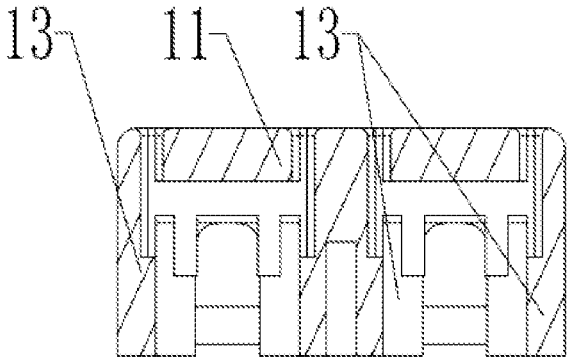
FIG. 6 is a sectional view at B-B in FIG. 3.

In the above embodiment, the contact frame 2 is configured as one of the clamping positions. Specifically, the width value a between the two mounting side portions 23 is 1.4 mm-2.4 mm, and the length value b of the inner bending is 0.5 mm to 1.1 mm. Referring to FIG. 4, the mounting side portion 23 is formed on both sides of the length direction of the support bottom plate 22, so that the width value of the mounting side portion 23 is approximately equal to the width size of the support bottom plate 22. In addition, when the width value a=1.9 mm, the allowable width tolerance range is ±0.5 mm, and when the length value b=0.8 mm, the allowable length tolerance range is ±0.3 mm, so as to ensure that the specification of contact frame 2 is better under these parameters, and the corresponding clamping position is more efficient and significant, which is conducive to clamping wires in small size and narrow environment, and greatly ensures the stability and effectiveness of the clamping process. In particular, the length size of the inner bending structure is at least half of the length size of the elastic member 211.

It should be noted that the opening value of the wire insertion space in the initial state is 30° to 60°. The wire enters the wire passing channel and is clamped in the contact frame 2 to switch the wire insertion space from the initial state to the working state, and the elastic members 211 are correspondingly triggered to move, so as to make the two inner bending structures are away from each other to stretch. Because the inner bending structure has elastic restoring force, the wires inserted between them can be clamped elastically. In other embodiments, the switching between the initial state and the working state can also be realized by the above operating mechanism, without too many restrictions.

To show the effectiveness of various embodiments of the present disclosure, the value of the spacing may be 0, 0.6 mm or any value between the two when the wire is not inserted. In particular, the floating value range of the spacing between the two ends of the free end of elastic members 211 is 0.1 mm to 0.3 mm, and the fluctuation range of the opening value is between 5° to 24°, so that the spacing can change between 0 and 0.9 mm after the wire is inserted, so as to clamp the wire or pull the wire away with adaptive elastic force. Moreover, the opening value of the wire insertion space formed by two inner bending structures can change with the value of the spacing after the wire is inserted, while the opening value is reduced regularly, which makes the value of the spacing and the opening value in inverse proportion.

Further, the floating value of the spacing and the fluctuation value of the opening value meets the following conditions: $K=10*n*L$, wherein, L is the value of floating value, K is the value of fluctuation value, n is constant and meets the following requirement: $5 \leq n \leq 8$. It is necessary to explain that the definition as followed: in the initial state, the spacing value is d, and the opening value is $\alpha$. Thus, when the wire is inserted, the distance between the ends of the two free ends of the elastic members 211 is d+L, and the opening value of the wire insertion space is $\alpha-K$. Moreover, the opening value decreases n degree of angle when the floating value increases by 0.1 mm. This setting relationship makes the inner bending structure different from the existing technology and has remarkable effect.

Furthermore, the spacing in the initial state and the diameter of the wire insertion hole 14 meets the following conditions: $D=m*d$, wherein, d is the spacing size in the initial state, D is the diameter size of the wire insertion hole 14, and m is a constant and meets the following requirements: $2 \leq m \leq 4$. It should be noted that the wire insertion hole 14 is configured as a circular hole with a constant diameter D to be adapted to the threading of the wire, and the diameter D of the wire insertion hole 14 is 2-4 times larger than the spacing size d, so that the wire specifications that enter the main body 1 through the wire insertion hole 14 can be adapted to the size parameters of the inner bending structure of the elastic member, effectively screening the wire specifications that will damage the internal contact frame 2 and improving the service life of the wiring clamp.

In some embodiments, as shown in FIG. 12, the value of the spacing is the minimum spacing distance between the two elastic members 211 at the free end, and the opening value is the value of the angle formed by the outer tangent lines at the two free ends. So that the wire from the outer side can be guided to enter through the wire insertion space with opening value, and the wire can be elastically clamped on the contact frame 2 by inserting in the spacing. In addition, the overall size of the connection terminal in this embodiment is within 10 mm-30 mm, which is a small connector structure, and each size is in the millimeter level, which requires high dimensional accuracy.

Figure 10:
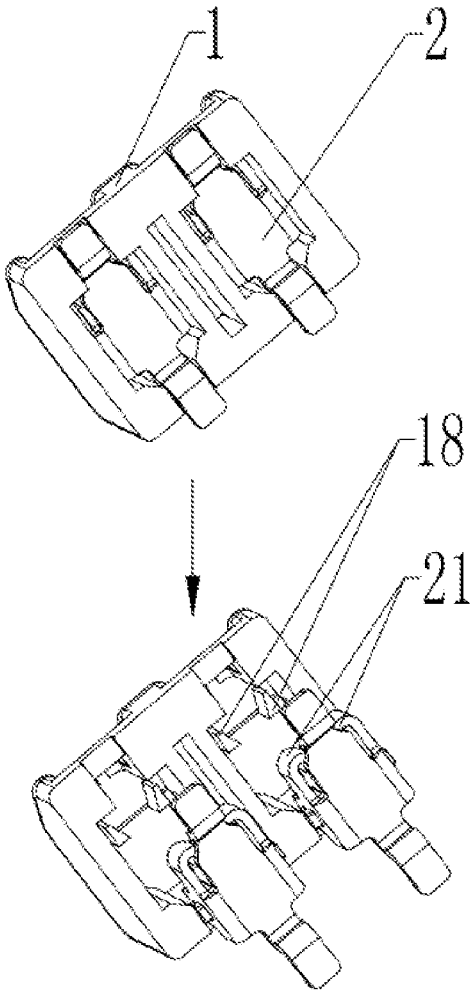
FIG. 10 is the structural diagram of the connection terminal of an embodiment of the present disclosure. The figure below is the disassembly diagram of the figure above.

Referring to FIG. 9 and FIG. 10, in one embodiment, the bottom surface 12 is vertically aligned and depressed by sinking, so that the main body 1 is configured as a shell with a hollow bottom surface. The internal space of the plastic shell main body includes the first mounting cavity 1C and the second mounting cavity 1D, the first mounting cavity 1C and the second mounting cavity 1D form a stepped bottom surface, and the clamping portion of the conductive terminal is located in the second mounting cavity 1D, so as to bear some or all force when the wires is inserted into the conductive terminal. Specifically, a stepped surface 111 is formed at the inner wall of the top surface 11 by at least the sinking recess, and the stepped surface 111 is higher than the inner wall of the top surface 11, wherein, the vertical alignment depression setting is to meet the conditions of rapid demolding, and the stepped surface 111 is higher than the inner wall of the top surface 11, so that the thickness of part of the top surface 11 is supported by the stepped surface 111, which stabilizes the main body 1. Meanwhile, a concave-convex shaped internal space is formed for the snap-fit assembly of the conductive terminal.

In some embodiments, the clamp boss 18 is arranged in avoidance setting relative to the inner bending structure of the contact frame 2, and is arranged on the stretching and moving path of the inner bending structures. The clamp boss 18 is used to limit the continuous stretching activity of the inner bending structures and prevent the clamping failure of the clamping joint 21. The clamp boss 18 is arranged on the moving path of the inner bending structures, and is matched with the inner bending structures in the initial state in the way of interval setting, so that the inner bending structures can contact with the clamp boss after the wire is inserted and moves to the limit position.

In this embodiment, the wire is clamped and fixed through the clamping joint 21 of the contact frame 2. The clamping joint 21 is composed of a pair of elastic members 211, and the free ends of the elastic members 211 are configured as inner bending structures, and the two inner bending structures symmetrically arranged on the contact frame 2 can clamp the wire on the contact frame 2 tightly. It is particularly important that in order to avoid failure due to elastic fatigue of the clamping force of the inner bending structures, the clamp boss 18 arranged on the main body 1 is used to limit the continuous stretching activity of the inner bending structures and prevent the clamping failure of the clamping joint 21.

Specifically, the clamp boss 18 is integrally formed in the second mounting cavity 1D on the stepped surface 111. The clamp boss 18 can infinitely approach the contact frame 2 assembled in the main body 1, and is separated from the inner bending structures and is located in the stretching path, so that the clamp boss can contact the elastic members 211 when the inner bending structures move to the limit position, which fundamentally prevents the elastic fatigue phenomenon of the leaf spring. Such that the service life of the clamping joint 21 is further increased. In addition, the clamp boss can prevent the elastic bending of the inner bending structures from exceeding the limit position, which can effectively classify the wire specifications suitable for clamping, so as to ensure that the conductive terminal always works normally within the allowable range of motion of the inner bending structures.

In one embodiment, the clamp boss 18 extends in the length direction to contact the contact frame 2 to limit the contact frame 2 in the internal space, so that the contact frame 2 is separated from the stepped surface 111. Herein, the contact frame 2 assembled in the main body 1 can contact with the clamp boss 18 in the installment position, so as to ensure that the contact frame 2 is installed in place, and the contact frame is also separated from the stepped surface 111 to avoid damage to the contact frame 2 during assembly. In addition, preferably, the distance between the clamp boss 18 and the inner bending structure in the initial state is 0.15 mm to 0.3 mm. Such distance setting enables the inner bending structure to be used normally within its floating value range. The clamp boss 18 on one side of the inner bending structure is arranged at a preset distance setting, thus effectively avoiding the use of elastic joint 21 beyond the range and ensuring the service life.

Obviously, the configuration of the through hole 16, the retaining wall 17, and the clamp boss 18 can meet the design concept of one-time demoulding along the vertical direction of the plastic shell body 1, which will not be repeated here for brevity.

Referring to FIG. 14 to FIG. 17, in one embodiment, the clamping portion 231 is configured to make the contact frame 2 snap-fit in the main body 1 through the wing structures on both sides, the support bottom 22 is transversely placed on the bottom surface of the main body 1 along its length direction, and the plastic shell main body 1 is a shell shape with a hollowed bottom surface, so that the contact frame 2 can be assembled in the main body 1 from top to bottom, so as to at least partially block the bottom surface of the main body 1, avoiding the contact frame 2 from being directly exposed outside the main body 1, which facilitates the disassembly and assembly of the contact frame 2 in the main body 1. In this embodiment, the clamping portion 231 is referred to the wing structures on both sides of the mounting side portion 23, please refer to FIG. 16, the wing structures on both sides of the mounting side portion 23 are the swing arms 231, i.e., the clamping portion 231.

In one embodiment, the main body 1 is provided with a connecting portion 161 with a clamping surface matched with the mounting side portion 23. The mounting side portion 23 can be tightly matched with the clamping surface in a buckle way. Specifically, the mounting side portion 23 protrudes outwards and is provided with the swing arm 231, which is formed by stamping a partial body of the mounting side portion 23 and has an inclination angle that facilitates snapping into the mating structure. Thus, the swing arm 231 is directly raised in the partial body of the mounting side portion 23 to form a swing arm 231, which further enhances the snap-fit between the mounting side portion 23 and the matching structure, and the swing arm 231 has the function of elastic clamping, the design method is novel, and the providing of the inclination angle is more conducive to the disassembly and assembly of the contact frame 2.

In one embodiment, it should be noticed that the connecting portion 161 is formed by a through hole 16 on the top of the main body 1. The through hole 16 passes through the main body 1 and can be sunken in the inner wall of part of the main body 1. The swing arm 231 is provided with a first position protruding out of the mounting side portion 23 and a second position which is contacted by the inner wall of the main body 1 for avoidance movement by elastic force. The swing arm 231 can be kept in the first position when the swing arm 231 is in the initial state and when the swing arm is placed in the inner wall of the through hole 16. The swing arm 231 in the first position can be switched to the second position when the contact frame 2 is assembled into the main body 1 and contacts with the inner wall of the main body 1. After it is installed in the inner wall of the through hole 16, the swing arm 231 can be reset to the first position to limit the contact frame 2 in the main body 1. By this configuration, the swing arm 231 and the connecting portion 161 are more reliable, and the assembly and removal are convenient.

In one embodiment, the swing arm 231 is approximately in a folded plate shape, which includes a connecting portion 2311 formed at the upper end and connected with the mounting side portion 23, and a movable portion 2312 located at the lower end and protruding from the end face of the mounting side portion 23. The swing arm 231 is protruded outwardly from top to bottom as a whole, and has an inclination angle of 15° to 30°, wherein, the movable portion 2312 at the lower end is more conducive to the bottom-up assembly way, avoiding locking and jamming or interference. In addition, the protruding swing arm 231 can move freely without being interfered by the mounting side portion 23, and the inclination angle is maintained between the effective threshold of 15° to 30°, so as to achieve more efficient assembly and disassembly.

Figure 18:
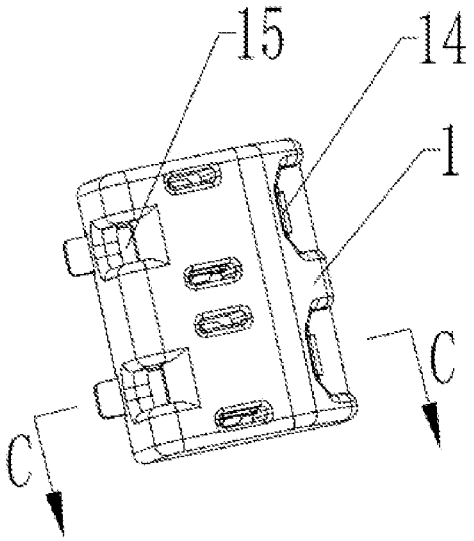
FIG. 18 is a structural diagram of the connection terminal of the embodiment of the present disclosure from another perspective.
Figure 19:
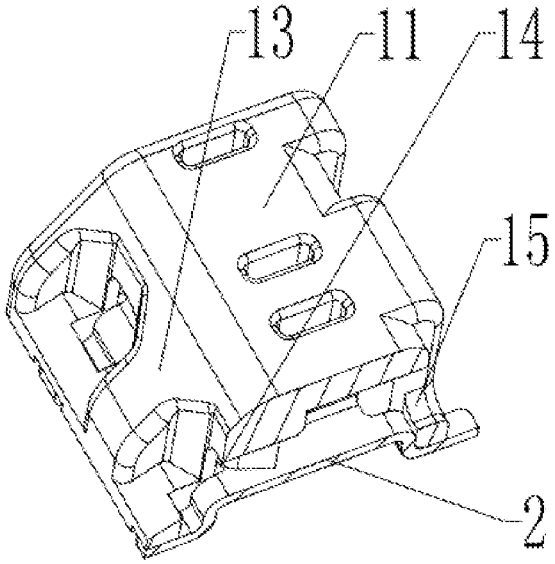
FIG. 19 is a sectional view at C-C in FIG. 18.

In some embodiments, referring to FIG. 18 and FIG. 19, the wire passing channel formed in the main body 1 is located between the wire insertion hole 14 and the exposed opening 15. After the wire crosses through the wire insertion hole 14 and enters into the wire passing channel, the contact frame 2 can hold the wire and allow the wire to continue to pass through the main body 1 until the end of the wire at least partially passes through the exposed opening 15, so that the user can directly observe the wire exposed outside the exposed opening 15.

The above is only the preferred embodiment of the present disclosure, and the protection scope of the present disclosure is not limited to the above embodiments. All technical solutions under the concept of the present disclosure belong to the protection scope of the present disclosure.

What is claimed is:

1. A plastic shell for mounting a connection terminal, comprising a main body configured as an integral single component; the main body comprises a top surface and a bottom surface that are opposed to each other, the bottom surface is depressed toward the top surface to form an internal space for accommodating a conductive terminal, the internal space is provided with a connecting portion for mating with a clamping portion of the conductive terminal; a front end surface of the main body is provided with a wire insertion hole for inserting a wire into the conductive terminal, and the wire insertion hole is communicated with the internal space;

the top surface is cut and extends downward to the bottom surface of the main body at an entrance of the the wire insertion hole, so as to form a first cutting surface at the front end surface of the main body and a second cutting surface at the bottom surface of the main body, wherein the first cutting surface is located at upper position of the wire insertion hole and the second cutting surface is located at lower position of the wire insertion hole, a projection of the first cutting surface and a projection of the second cutting surface in a direction which is vertical to a direction of the wire insertion hole are not overlapped;

wherein the front end surface of the main body forms a guiding area centered on the wire insertion hole, and the guiding area is configured to guide wires to be inserted into the wire insertion hole, wherein the guiding area is not vertical to the first cutting surface.

2. The plastic shell for mounting a connection terminal according to claim 1, wherein the top surface of the main body is cut and extends towards the bottom surface, and is in communication with the internal space to form the connecting portion.

3. The plastic shell for mounting a connection terminal according to claim 1, wherein the wire insertion hole extends backward and penetrates through a rear end surface of the main body, so as to make the inserted wire penetrate the main body.

4. The plastic shell for mounting a connection terminal according to claim 3, wherein the top surface and the bottom surface are enclosed by the side wall to form a hollow shell shape; wherein the wire insertion hole penetrates on the side wall, and an exposed opening is correspondingly provided along the side wall opposite to the wire insertion hole, and the exposed opening is formed by depressing along an outer periphery of the top surface and hollowing out the side wall;

the wire insertion hole and the exposed opening are communicated with the internal space.

5. A connection terminal, comprising a plastic shell for mounting a connection terminal and a conductive terminal arranged in the plastic shell body according to any one of claims 1; wherein the conductive terminal is a contact frame, and the contact frame is provided with a clamping joint for wire to insert and the clamping portion for clamping with the connecting portion of the plastic shell; wherein, the damping joint is composed of a pair of elastic members, and free ends of the two elastic members form inner bending structures and the inner bending structures are symmetrically arranged in the contact frame, so that the wire is clamped elastically after the wire enters into a wire passing channel along the wire insertion hole of the main body;

the mounting side portion is vertically configured on both sides of the support bottom to f orm two wing structures, the contact frame is clamped and assembled in the main body by the two side wing structures, wherein the clamping portion is the wing structures.

6. The connection terminal according to claim 5, wherein the contact frame is integrally formed by metal parts, comprising a support bottom and a mounting side portion; the support bottom is in strip plate shape and is located below the wire passing channel, a length direction of the support bottom is consistent with a direction of the wire passing channel.

7. The connection terminal according to claim 6, wherein the elastic member is a leaf spring, and the leaf spring is extended and arranged at the mounting side portion and directs to a opposite direction of wire insertion; an end of the elastic member far away from the free end is provided at one side of the mounting side portion in an integrated manner, and forms an elastic free end transversely arranged on the support bottom by at least once bending inward.

8. The connection terminal according to claim 7, wherein the clamping position of the contact frame is: a width between the two mounting side portions is 1.4 mm to 2.4 mm, and the length of the inner bending is 0.5 mm to 1.1 mm.

9. The connection terminal according to claim 5, wherein the internal space of the plastic shell body comprises a first mounting cavity and a second mounting cavity, the first mounting cavity and the second mounting cavity form a stepped bottom surface, and the clamping portion of the conductive terminal is located in the second mounting cavity, so as to bear some or all force when the wires is inserted into the conductive terminal.

* * * * *